US009153923B2

(12) United States Patent
Pocrass

(10) Patent No.: US 9,153,923 B2
(45) Date of Patent: Oct. 6, 2015

(54) USB POWER ADAPTER WITH INTEGRATED MALE AND FEMALE CONNECTORS TO CHARGE AND SYNC FUNCTIONS

(75) Inventor: Alan L. Pocrass, Simi Valley, CA (US)

(73) Assignee: Alan L. Pocrass, Simi Valley, CA (US)

( * ) Notice: Subject to any disclaimer, the term of this patent is extended or adjusted under 35 U.S.C. 154(b) by 0 days.

(21) Appl. No.: 13/211,669

(22) Filed: Aug. 17, 2011

(65) Prior Publication Data

US 2012/0045939 A1 Feb. 23, 2012

Related U.S. Application Data

(60) Provisional application No. 61/401,811, filed on Aug. 19, 2010.

(51) Int. Cl.

| | |
|---|---|
| ***H01R 24/00*** | (2011.01) |
| ***H01R 25/00*** | (2006.01) |
| ***H01R 27/02*** | (2006.01) |
| ***H01R 31/06*** | (2006.01) |

(52) U.S. Cl.
CPC ..... *H01R 31/065* (2013.01)

(58) Field of Classification Search
CPC ..... H01R 31/065; H01R 31/06
USPC ..... 439/638, 131–135; 320/103–106
See application file for complete search history.

(56) References Cited

U.S. PATENT DOCUMENTS

| | | | | |
|---|---|---|---|---|
| 7,407,390 | B1 * | 8/2008 | Ni | 439/76.1 |
| 7,511,233 | B2 * | 3/2009 | Pocrass | 174/541 |
| 8,358,100 | B2 * | 1/2013 | Helfrich | 320/106 |
| 2005/0009404 | A1 * | 1/2005 | Lee | 439/638 |
| 2005/0086413 | A1 * | 4/2005 | Lee et al. | 710/313 |
| 2005/0170699 | A1 * | 8/2005 | Overtoom | 439/639 |
| 2006/0019543 | A1 * | 1/2006 | Charna | 439/638 |
| 2006/0199427 | A1 * | 9/2006 | Chan | 439/505 |
| 2010/0219790 | A1 * | 9/2010 | Chadbourne et al. | 320/107 |

* cited by examiner

*Primary Examiner* — Felix O Figueroa
(74) *Attorney, Agent, or Firm* — The Webb Law Firm

(57) ABSTRACT

A USB power adapter includes a printed circuit board, a male USB connector coupled to the printed circuit board and configured to mate with a female USB connector of a first device; and a female USB connector coupled to the printed circuit board and configured to mate with a male USB connector of a cable which has a non-USB device connector on its other end for connection to a second device. Circuitry integrated on the printed circuit board electrically couples the male USB connector and the female USB connector. More specifically, the circuitry connects one or more pins of the male USB connector to one or more pins of the female USB connector whereupon the first device either supplies power to or synchronizes for data transfer with the second device when the first and second devices are connected via the power adapter and the USB cable.

6 Claims, 5 Drawing Sheets

| PIN | NAME | CABLE COLOR | DESCRIPTION |
|---|---|---|---|
| 1 | VCC | RED | +5VDC |
| 2 | D- | WHITE | DATA- |
| 3 | D+ | GREEN | DATA+ |
| 4 | GND | BLACK | GROUND |

FIG. 5

USB POWER ADAPTER WITH INTEGRATED MALE AND FEMALE CONNECTORS TO CHARGE AND SYNC FUNCTIONS

CROSS REFERENCE TO RELATED APPLICATION

This application claims priority from U.S. Provisional Patent Application No. 61/401,811, filed Aug. 19, 2010, which is incorporated herein by reference.

BACKGROUND OF THE INVENTION

1. Field of the Invention

The present invention relates to a USB adapter that can be used as an interface between a conventional USB cable (that includes a USB connector and a non-USB connector at opposite ends) and an intelligent electronic device, such as, without limitation, a laptop or desktop computer, a USB hub, or any other USB enabled device and, more particularly, to a USB adapter with integrated male USB and female USB connectors for connection between a conventional USB cable and the USB port of the intelligent electronic device to add functionality in applications where a device connected to the non-USB connector end of the conventional USB cable does not conform to USB standards.

2. Description of Related Art

Universal Serial Bus (USB) cables are designed to work with devices that are designed to well known USB standards. Typically, a USB cable connected via its male USB plug to a mating female USB connector of an intelligent electronic device, such as a desktop or laptop computer, a USB hub, or any other type or variety of USB enabled device, can be utilized to transfer data to or from a device connected to the non-USB connector end of the USB cable and/or to transfer power from the intelligent electronic device to the device connected to the non-USB connector end of the USB cable. Heretofore, if the device connected to the non-USB connector end of the USB cable was not compatible with USB standards, said device would not be able to establish data communication with the intelligent electronic device and/or would not be able to receive electrical power from the intelligent electronic device.

Accordingly, a need exists for a USB adapter that can act as an interface with a conventional USB cable that connects an intelligent electronic device and a device that is non-USB standard compliant to enable one- or two-way data communication between the devices and/or to enable electrical power to be supplied to the non-USB standards compliant device from the intelligent electronic device.

SUMMARY OF THE INVENTION

The present invention is a USB power adapter that includes hardware circuitry and integrated male and female connectors. The USB power adapter includes a printed circuit board (PCB); a male connector mounted to the PCB and configured to mate with the female USB connector of another device, such as, without limitation, an intelligent electronic device; and a female connector mounted to the PCB and configured to mate with the male connector of a conventional USB cable which has a non-USB connector at its other end. The male USB connector and the female USB connector of the USB power adapter are electrically coupled via the PCB which can support hardware circuitry for charging a device attached to the non-USB device connector of the conventional USB cable. The conventional USB cable has a male USB connector to attach to the female connector of the USB power adapter. The other end of the conventional USB cable, referred to herein as "USB cable", has a non-USB connector, a.k.a., a device connector, to connect to a variety of devices, such as, without limitation, a smartphone, a cellphone, an electronic book reading device, an electronic portable computer, and other like electronic devices. The USB power adapter does not include a source of electrical power or an integrated circuit.

The male connector of the USB power adapter can be mated with a female USB connector of a car power adapter to charge a device attached to the device connector of the USB cable. The USB power adapter male connector can be mated with a female USB connector of a USB power supply to charge the device attached to the device connector of the USB cable. The female connector of the USB adapter is configured to mate with a male connector of the USB cable for transferring power and/or data to the device attached to the device connector of the USB cable.

The USB power adapter facilitates charging devices used for computing, to display books on a display screen, etc. Some of these devices have problems charging via a USB cable connected directly between the device and a computer. One example of this is the Apple® iPad. "Apple" and "iPad" are registered trademarks of Apple Inc. of Cupertino, Calif. Specifically, users of non-Apple computers and certain models of Apple computers cannot use such computers to charge an iPad unless they use a 120V electrical wall outlet and Apple available power adapter (a.k.a., a charging brick) that comes with a new iPad or is available separately from Apple. To this end, unless a laptop or desktop has a 2.0 USB connector which will operate with the iPad for charging, Apple Inc. states on its website that some USB 2.0 ports and accessories do not provide enough power to charge an iPad. When this occurs the message "Not Charging" appears in the status bar of the iPad next to the battery icon.

An iPad will successfully charge via the charging brick connected to a conventional wall outlet utilizing the accompanying USB cable. Moreover, the iPad will successfully charge when connected to USB ports of Apple products such as the iMac® and/or the MacBook® Pro®. "iMac", "MacBook", and "MacBook Pro" are registered trademarks of Apple Inc. of Cupertino, Calif. However non-Apple brand computers (a.k.a., PCs) as a whole have a problem in that the iPad does not charge correctly when connected to a PC via a USB cable that has a male USB connector as one end and a non-USB device connector on the other end. The iPad also does not charge correctly when connected to certain older Apple products, such as, without limitation, an older model MacBook Pro via such USB cable. The iPad does not charge through USB hubs, regardless of what the USB hub is connected to.

The USB power adapter of the present invention has been designed to solve the above problem. Simply attaching the USB power adapter of the present invention to an existing Apple USB cable with a male USB connector and a non-USB device connector at opposite ends enables an iPad to be charged from a PC's USB port, or the USB port of certain older model Apple® products without the need for a charging brick or a wall outlet.

The USB power adapter of the present invention can also include integrated power logic and a switch or button which enables the USB power adapter to switch between charging a device or synchronize the device to an attached computer.

BRIEF DESCRIPTION OF THE DRAWINGS

FIG. 5 is a chart of standard USB pins and their function in the male USB connector of the USB cable shown in FIG. 3.

DETAILED DESCRIPTION OF THE INVENTION

The present invention will be described with reference to the accompanying figures where like reference numbers correspond to like elements.

Figure 1:
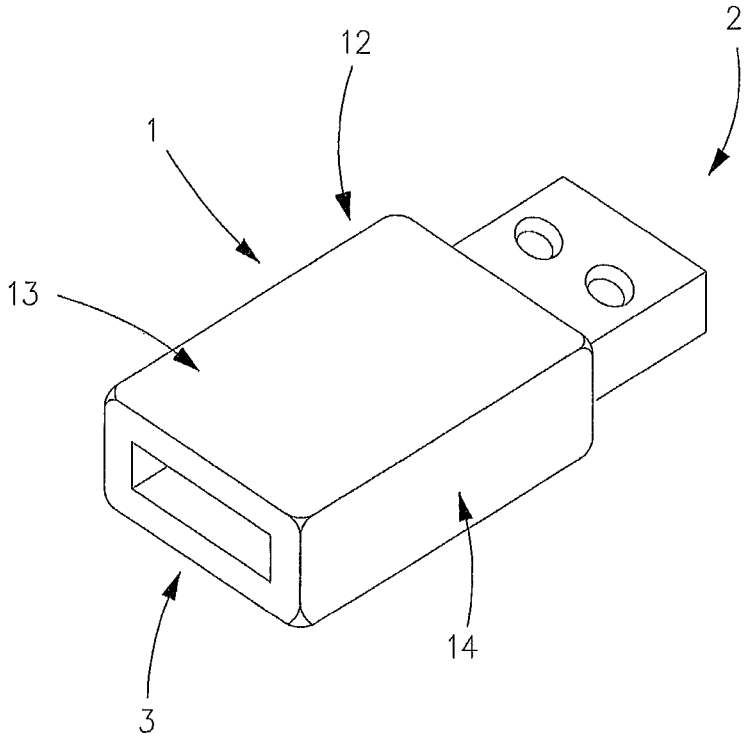
FIG. 1 is a perspective view of a USB power adapter in accordance with an embodiment of the present invention with integrated hardware circuitry (not shown) and male and female USB connectors.
Figure 2:
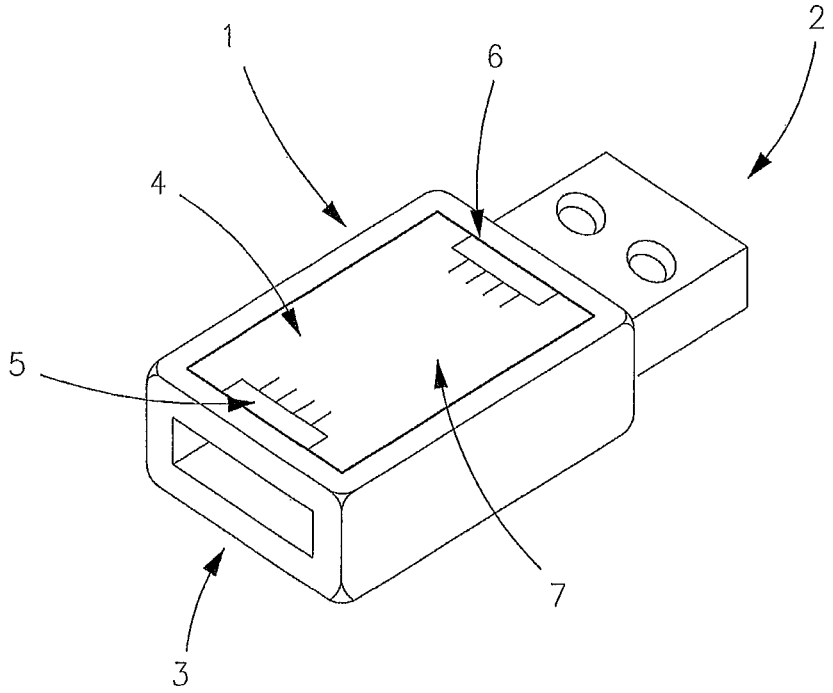
FIG. 2 is a partially cutaway view of the USB power adapter of FIG. 1 showing on the interior thereof a printed circuit board (PCB) with the male and the female USB connectors attached to the PCB.
Figure 3:
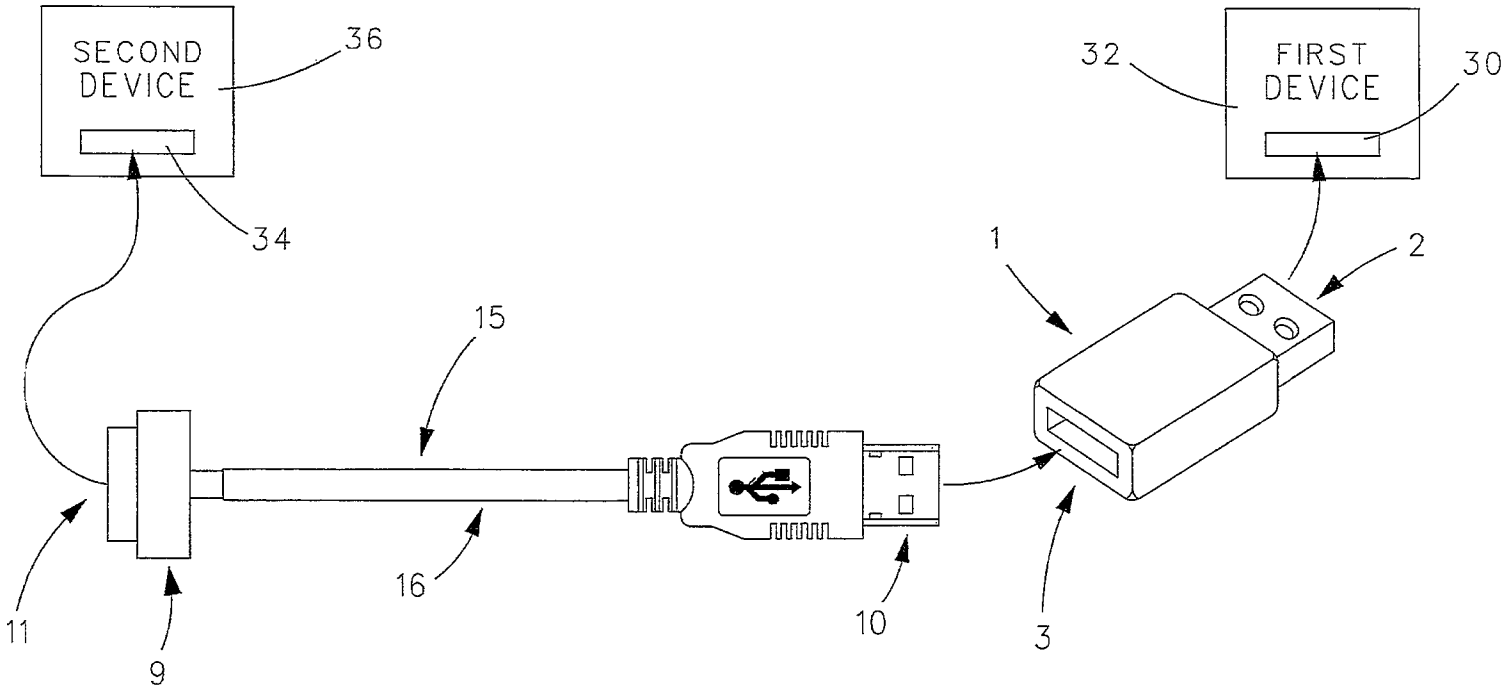
FIG. 3 is an illustration of the USB power adapter of FIG. 1 and a USB cable that has a male USB connector and a non-USB device connector on opposite ends showing the insertion of the male USB connector into the female USB connector of the USB power adapter.

With reference to FIGS. 1-3, a USB power adapter 1 of the present invention includes a housing 12, a male USB connector 2, a female USB connector 3, and a printed circuit board (PCB) 7 inside housing 12.

Housing 12 can include a top cover 13 and a bottom cover 14 which can mate around printed circuit board 7 and a portion of male USB connector 2 and a portion of female USB connector 3 to form a protective housing. These covers can be made of a variety of materials, but are desirably made from, without limitation, plastic or metal. Alternatively, housing 12 can be a unitary piece.

Male USB connector 2 and female USB connector 3 are mounted to PCB 7 by soldering, surface mount technology, press fitting or other means of mounting known in the art. Male USB connector 2 is configured to mate with a female USB connector 30 of a first (intelligent) device 32, such as, without limitation, a desktop computer, laptop computer, palm device, or an interface cable that connects to such an intelligent device, etc. Female USB connector 3 is configured to mate with a male USB connector 10 of a USB cable 15 which has a non-USB device connector 9 at the other end for connection to a mating device connector 34 of a second device 36, such as, without limitation, an Apple iPad, an Apple iPod, an Apple iPhone, an Apple iTouch, or any other device produced by any other manufacturer. The foregoing list of devices is not intended to limit the type or style of device connector 9 as it is envisioned that device connector 9 can be any suitable and/or desirable type or style to mate with connector 34 of second device 36. Second device 36 attached to USB cable 15 and USB cable 15 attached to USB power adapter 1, which is attached to first device 32 will permit second device 36 to charge from first device 32 and/or will enable first device 32 and second device 36 to synchronize for data transfer in a first direction from first device 32 to second device 36, in a second direction from second device 36 to first device 32, or in both directions.

Figure 4:
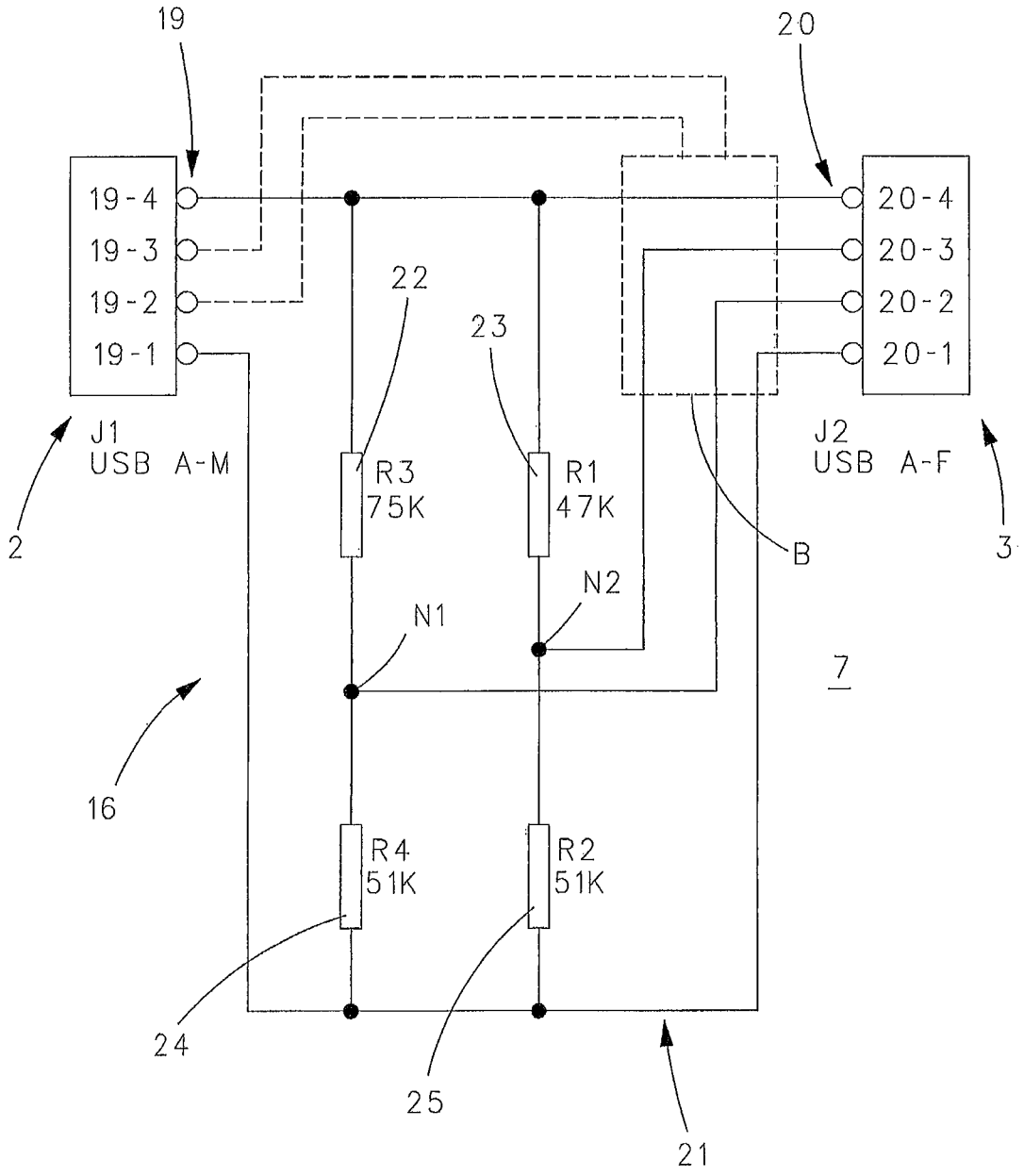
FIG. 4 is a schematic diagram of the hardware circuitry of the USB power adapter of FIG. 1, which hardware circuitry is disposed on the PCB that is inside the USB power adapter and which circuitry connects with the female USB and the male USB connector of the USB power adapter.

With reference to FIG. 4 and with continuing reference to FIGS. 1-3, USB power adapter 1 includes integrated PCB 7 that includes circuitry 16, e.g., a pattern of conductors and a biasing network comprising an arrangement of resistors, that configure the pins of female USB connector 3 to the pins of male USB connector 2 so that first device 32 attached to USB cable 15 via USB power adapter 1 can provide power to and/or synchronize for data transfer with second device 36 coupled to the device connector 9 of USB cable 15.

USB connectors normally include 4 to 5 pins each per USB standards. FIG. 4 is a schematic diagram of circuitry 16 disposed on PCB 7 connecting pins 20 and 19 of female USB connector 3 and male USB connector 2. Circuitry 16 includes a pattern of traces 21 and resistors 22-25 connected between pins 20 and 19 of female USB connector 3 and male USB connector 2, respectively, in the manner shown in FIG. 4. Female USB connector 3 is a J2 USB A-F that includes four pins 20-1-20-4. Male USB connector 2 is a J1 USB A-M connector that includes four pins 19-1-19-4.

Traces 21 connect pins 20 of female USB connector 3 to pins 19 of male USB connector 2 in the manner shown in FIG. 4. Specifically, pin 20-1 of female USB connector 3 connects to pin 19-1 of male USB connector 2. Pin 20-2 of female USB connector 3 connects to a node N1 between resistors R3 and R4. The end of resistor R3 opposite node N1 is connected to the trace that connects pins 20-4 and 19-4. The end of resistor R4 opposite node N1 is connected to the trace that connects pin 20-1 of female USB connector 3 and pin 19-1 of male USB connector 2. Pin 20-3 of female USB connector 3 is connected to a node N2 between resistors R1 and R2. The end of resistor R1 opposite node N2 is connected to the trace that connects pins 20-4 and 19-4. The end of resistor R2 opposite node N2 is connected to the trace that connects pins 20-1 and 19-1. In the illustrated embodiment, pins 19-2 and 19-3 of male USB connector 2 are not connected to any of traces 21. However, this is not to be construed as limiting the invention. Resistors R1, R2, R3 and R4 desirably include the values shown in FIG. 4. However, these resistor values can be modified if necessary and/or desirable.

USB power adapter 1 can be attached to USB cable 15 by inserting male USB connector 10 of USB cable 15 into female USB connector 3 of USB power adapter 1. USB power adapter 1, in-turn, can be attached to first device 32 by inserting male USB connector 2 into female USB connector 30 of first device 32. USB cable 15 includes cable 16 with integrated wires covered by protective cladding. USB cable 16 also includes device connector 9, including pins 11, which is attached to the end of USB cable 15 opposite male USB connector 10.

USB power adapter 1 can include an optional switch or button B (shown in phantom in FIG. 4) to control whether second device 36 is either charged by or synchronized for data transfer with first device 32 when devices 32 and 36 are coupled together via USB cable 15 and USB power adapter 1 in the manner shown in FIG. 3. When switch or button B is in a first state, pins 20-2 and 20-3 of female USB connector 3 are connected to nodes N1 and N2 in the manner shown in FIG. 4. However, when switch or button B is activated into a second state, pins 20-2 and 20-3 are disconnected from nodes N1 and N2 and are connected to pins 19-3 and 19-2, respectively, of male USB connector 2 to facilitate data synchronization and data transfer in a first direction from device 32 to device 36, in a second direction from device 36 to device 32, or in both directions. PCB 7 includes separate traces (shown in phantom in FIG. 4) which connect between switch or button B and pins 19-3 and 19-2 to permit this connection.

While the present invention has been described with reference to preferred embodiments of USB power adapter 1 with integrated male and female connectors 2 and 3, those skilled in the art may make modifications and alterations to the present invention without departing from the scope and spirit of the invention. Accordingly, the above description is intended to be illustrative rather than restrictive. The invention is defined by the appended claims, and all changes to the invention that fall within the meaning and range of equivalency of the claims are to be embraced by their scope.

The invention claimed is:

1. A USB power adapter comprising:

a printed circuit board;

a male USB connector coupled to the printed circuit board and configured to mate with a female USB connector of a first device;

a female USB connector coupled to the printed circuit board and configured to mate with a male USB connector of a cable which has a non-USB device connector on its other end for connection to a second device; and circuitry including a resistive biasing network integrated on the printed circuit board connecting one or more pins of the male USB connector of the USB power adapter to one or more pins of the female USB connector of the USB power adapter, the resistive biasing network operative for stepping down a voltage supplied by the first device to the second device when the first and second devices are connected via the power adapter and the cable, wherein the USB power adapter does not include a source of electrical power or an integrated circuit.

2. The USB power adapter of claim 1, further comprising an enclosure surrounding the printed circuit board.

3. The USB power connector of claim 1, wherein each USB connector is a mini-USB or a micro-USB connector.

4. The power adapter of claim 1, wherein the circuitry includes a switch or button that is switchable between first and second states where the first device respectively supplies and does not supply power to the second device.

5. The power adapter of claim 1, wherein the circuitry includes a pattern of conductors.

6. A method of coupling a first device to supply stepped down electrical power to a second device comprising:

(a) coupling a male USB connector of a power adapter to a female USB connector of a first device;

(b) coupling a male USB connector of a cable to a female USB connector of the power adapter; and (c) coupling a non-USB, device connector of the cable to a mating connector of a second device, wherein the power adapter includes a resistive biasing network which enables the second device to receive stepped down electrical power from the first device, wherein the power adapter does not include a source of electrical power or an integrated circuit.

* * * * *